US005551081A

United States Patent [19]

Starnes et al.

[11] Patent Number: 5,551,081

[45] Date of Patent: Sep. 3, 1996

[54] NECK PROTECTING DEVICE

[75] Inventors: Dennis P. Starnes; John C. Mason; Stephen M. Thompson, all of Mt. Pleasant, Mich.

[73] Assignee: STM, Inc., Mt. Pleasant, Mich.

[21] Appl. No.: 207,384

[22] Filed: Mar. 8, 1994

[51] Int. Cl.[6] ..... A41D 13/00

[52] U.S. Cl. ..... 2/2

[58] Field of Search ..... 2/44, 45, 2; 602/17, 602/18, 19; 128/DIG. 23

[56] References Cited

U.S. PATENT DOCUMENTS

| | | | |
|---|---|---|---|
| 1,510,187 | 9/1924 | Martin . | |
| 1,992,904 | 2/1935 | Preston | 602/17 |
| 3,048,860 | 8/1962 | Richardson | 128/DIG. 23 X |
| 3,657,739 | 4/1972 | Holmes, Sr. | 2/2 |
| 4,204,529 | 5/1980 | Cochrane | 602/19 |
| 4,757,554 | 7/1988 | Blair | 2/2 |
| 5,056,508 | 10/1991 | Brunell | 602/18 |
| 5,060,639 | 10/1991 | Marcus | 602/19 |

FOREIGN PATENT DOCUMENTS

| | | | |
|---|---|---|---|
| 360161 | 3/1962 | Switzerland | 602/17 |

*Primary Examiner*—Paul C. Lewis
*Attorney, Agent, or Firm*—Learman & McCulloch

[57] ABSTRACT

A device for protecting a person's neck comprises an arcuate, resilient body formed of cushioning material terminating at its opposite ends in arms which are movable toward and away from one another. A flexible, U-shaped mounting strap is joined to free ends of the arms so that the arcuate body and the mounting strap together form an endless loop. An anchor strap extends transversely of the loop and is joined at its opposite ends to the mounting strap. The anchor strap is adjustable in length so as to position the opposite ends of the arcuate body a selected distance from one another and to inhibit movement of such arms in directions away from one another.

20 Claims, 2 Drawing Sheets

NECK PROTECTING DEVICE

This invention relates to a device for protecting the neck of an athlete and more particularly to a neck protecting device which may be applied to a person's body independently of any garment or other equipment worn by the person.

BACKGROUND OF THE INVENTION

The use of neck protecting devices by athletes such as football players is common. The conventional neck protective device comprises a U-shaped, cylindrical pad of resilient material which embraces the neck of the wearer and has its central section adapted to bear against the back of the person's neck, the central section terminating in two arms which extend forwardly and downwardly over the chest of the person. The terminal ends of the arm conventionally are fastened to a shoulder pad harness, a vest, or some other piece of equipment worn by the person.

One problem associated with a neck protective device which is secured to some other piece of equipment or garment is that such other piece of equipment or garment is capable of shifting its position on the wearer's body, thereby inevitably causing shifting of the neck protective device as well. Under these circumstances it sometimes happens that the neck protective device shifts its position to one that offers less protection at the very time maximum protection is needed.

Another disadvantage of currently available neck protective devices is that they are not as adjustable as is desirable. That is, it is desirable to be able to vary the radius of curvature of the neck embracing pad to accommodate different size persons. It also is desirable to make other adjustment to accommodate persons of different height. The known neck protective devices, however, do not possess these characteristics.

An object of this invention is to provide a neck protective device which overcomes the disadvantages referred to above.

SUMMARY OF THE INVENTION

A neck protective device constructed in accordance with the preferred embodiment of the invention comprising an arcuate, resilient pad terminating at two ends which are joined to corresponding ends of an inelastic mounting strap so that the arcuate pad and mounting strap together form an oval shaped loop. An inelastic anchor strap extends athwart the loop adjacent the arcuate pad and adjusts the relative positions of the ends of the arcuate pad. The anchor strap also limits the movement of the ends of the arcuate pad in a direction away from one another.

The arcuate pad embraces the neck of a person and is of sufficient length that its central section may bear against the back of the person's neck while the arms extend forwardly and downwardly over the upper torso of the person. The mounting strap is of such length as to extend downwardly and around the back of the person so as snugly to embrace the person's back. The anchor strap extends transversely and horizontally across the upper chest of the person and preferably is adjustable so as to position the arms of the arcuate pad snugly around the sides of the person's neck. Preferably, the mounting strap has a separable buckle at that end of the loop opposite the arcuate pad so as to permit the affective length of the mounting strap to be adjusted in such manner as to enable the arcuate pad and the mounting strap snugly to engage the body of the person.

THE DRAWINGS

The preferred embodiment of the invention is illustrated in the following drawings, wherein.

THE PREFERRED EMBODIMENT

Figure 1:
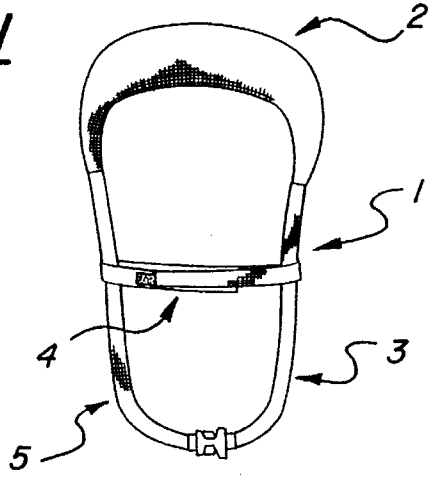
FIG. 1 is a small-scale elevational view of the protective device.
Figure 2:
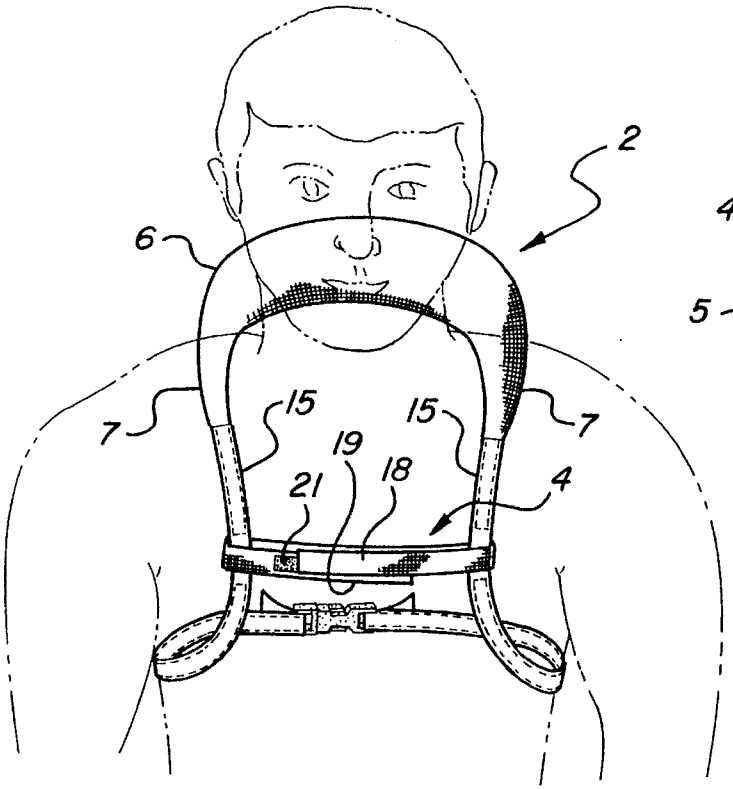
FIG. 2 is an enlarged, elevational view illustrating the manner in which the device may be applied to the body of a person.
Figure 3:
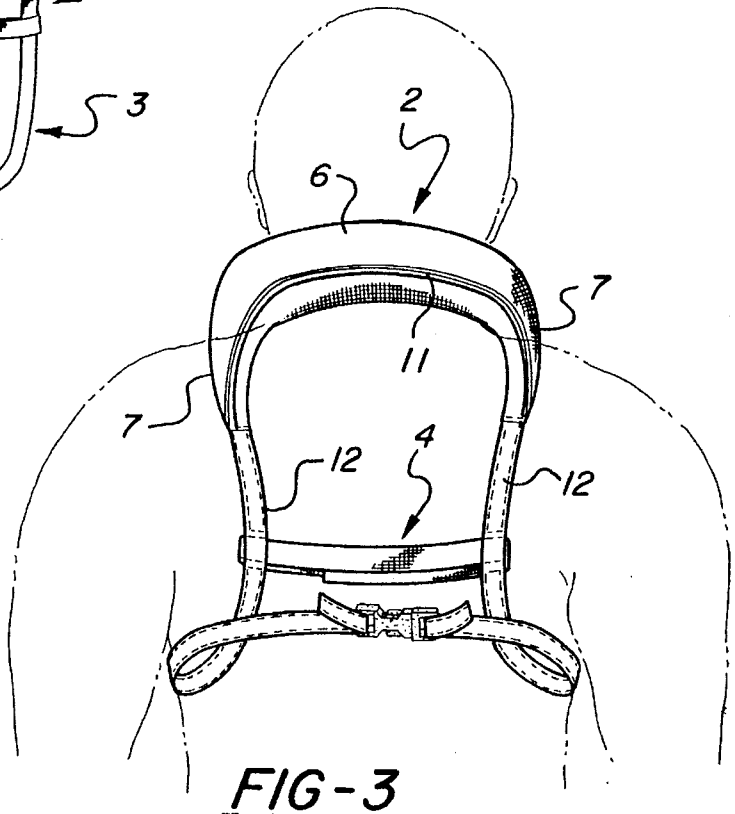
FIG. 3 is a rear elevational view of the device as illustrated in FIG. 2.
Figure 5:
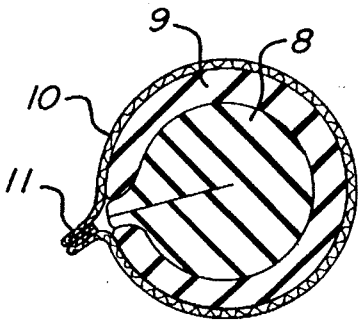
FIG. 5 is an enlarged, sectional view taken on the line 5—5 of FIG. 4.
Figure 4:
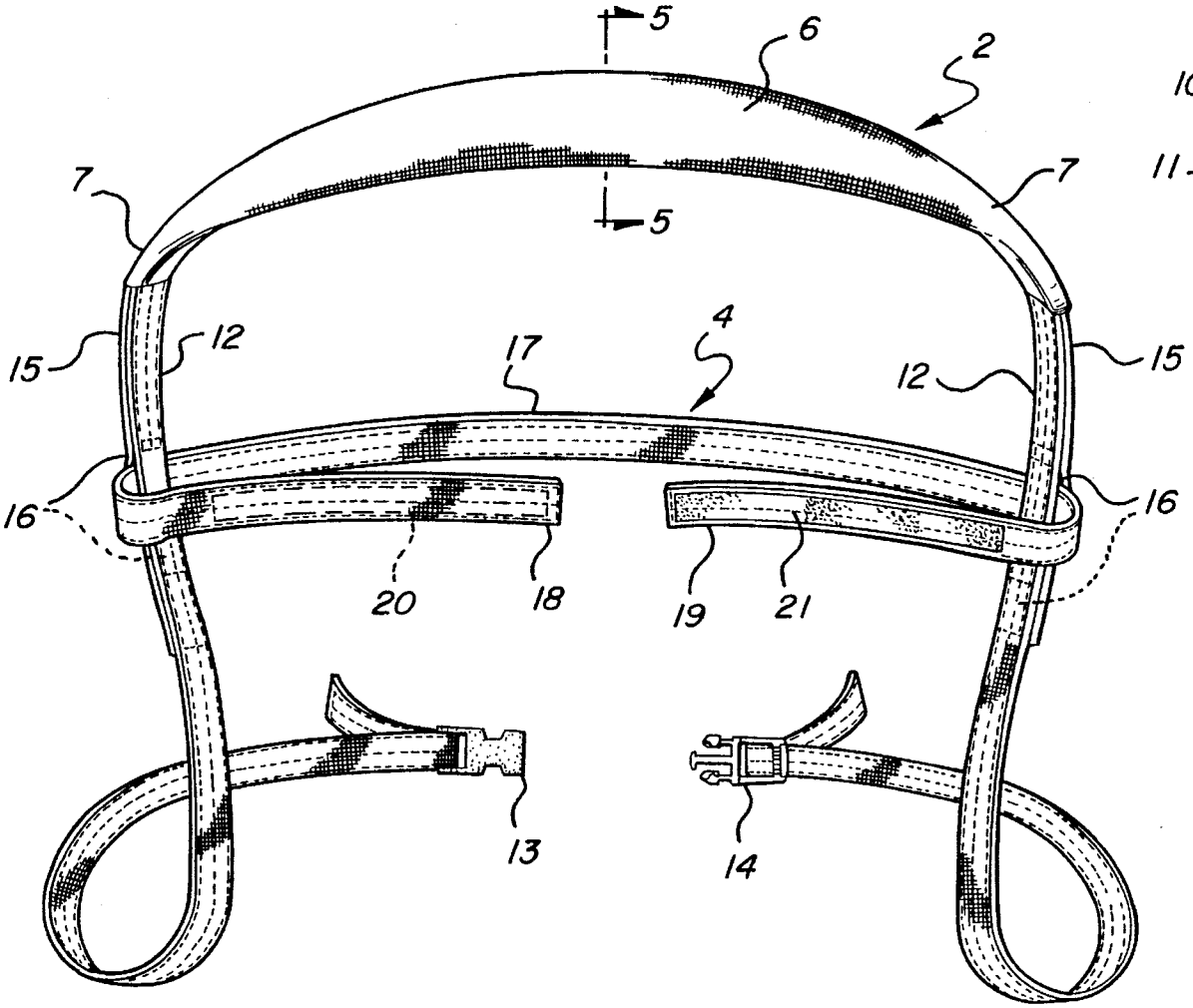
FIG. 4 is a front elevational view showing the apparatus in condition for application to a person.

A protective device constructed in accordance with a preferred embodiment of the invention is designated generally by the reference character 1 and comprises an arcuate body or pad 2, a flexible mounting strap 3, and a flexible anchor strap 4 coupled to the mounting strap. The pad 2 and the mounting strap 3 together form an oval shaped loop 5, and the anchor strap 4 extends athwart or transversely of the loop at a zone closer to the pad 2 than to the opposite end of the loop.

The pad 2 comprises an arcuate central section or bight 6 from which a pair of tapering arms 7 extend. The pad is composed of two resilient rolls 8 and 9 of cushioning material, the roll 8 comprising a substantially cylindrical body enclosed within the roll 9 which is annular in form. The rolls 8 and 9 are encased within a sheath 10 which preferably is formed of moisture resistent material such as closely woven nylon. The sheath 10 has confronting edges which are stitched or otherwise secured together to form a seam 11. Preferably, the rolls 8 and 9 are of different densities. The inner member 8 is denser than the outer member 9. The inner member may have a density of four pounds per cubic foot, whereas the outer member 9 has a density of three pounds per cubic foot. Each of the rolls 8 and 9 may be formed of a suitable material such as polyurethane foam.

The ends of the arms 7 of the pad 2 are stitched or otherwise suitably secured to corresponding ends of an inelastic mounting strap 12 formed of flexible or other suitable material. Opposite ends of the strap 12 are secured to separable and adjustable buckle components 13 and 14 of known construction which are diametrally opposite the pad 2. The buckle components enable the loop 5 to be opened and closed and adjustable in size.

Adjacent the ends of the arms 7 the strap 12 has stitched or otherwise secured thereto reinforcements 15. At intervals the reinforcements are stitched to the strap 12, thereby providing passages 16 spaced longitudinally of the strap 12.

The anchor strap 4 preferably comprises a length of inelastic webbing 17 of textile or other suitable material having its opposite ends extending through corresponding passages 16 and reversely turned to overlie one another. That surface of the webbing 17 which overlies the surface of the end 19 is provided with fastening means 20, such as hooks, and the end 19 is provided with cooperating fastening means, such as loops 21, which enable the overlying ends 18 and 19 to be secured to one another in any one of a number of selected positions.

To apply the protective device to the body of a person, the central portion 6 of the pad 2 is placed against the back of the person's neck with the arms 7 extending downwardly and overlying the upper part of the person's torso. The buckle parts 13 and 14 of the mounting strap 12 may be separated so that the strap extends downwardly and around the upper back of the person. The buckle parts then may be secured together and the length of the strap 12 adjusted so that the strap snugly bears against the person's back. At this time the anchor strap 4 may be passed through corresponding passages 16 and the ends 18 and 19 of the anchor strap secured to one another so that the anchor strap extends substantially horizontally and transversely across the upper chest of the person. Because the anchor strap 4 is adjustable, it is possible to adjust the effective length of the strap 4 and move the arms 7 of the pad 2 selectively toward and away from one another, thereby enabling the central portion 6 and the arms 7 of the pad to embrace the back and sides of the person's neck fairly snugly. That is, the radius of curvature of the pad 2 may be adjusted and maintained in a selected position from which movement of the arms 7 away from one another is limited by the anchor strap 4.

Since no part of the protective device 1 is joined to any other equipment, such as shoulder pads or a garment, the position of the neck pad 2 is independent of any other equipment. Consequently, the manner in which the neck pad embraces the neck of the wearer is virtually constant, regardless of the movements of the wearer.

The disclosed embodiment is representative of a presently preferred form of the invention, but is intended to be illustrative rather than definitive thereof. The invention is defined in the claims.

We claim:

1. A person's neck protecting device comprising a resilient body formed of cushioning material, said body having an arcuate bight from opposite ends of which a pair of arms extend, each of said arms terminating in a free end; a flexible mounting strap having opposite ends, the opposite ends of said mounting strap being joined to the free ends of the respective arms so that said body and said mounting strap together form an endless loop, said mounting strap having passages therein; and an anchor strap spanning said loop and extending through said passages, said anchor strap being coupled at opposite ends thereof to said mounting strap.

2. The device according to claim 1 wherein said mounting strap has a plurality of spaced pairs of said passages therein, said anchor strap being accommodated in a selected pair of said spaced passages.

3. The device according to claim 1 wherein said anchor strap extends through said spaced passages in said mounting strap and wherein said opposite ends of said anchor strap are reversely turned and overlie at least a portion of that part of said anchor strap which spans said loop.

4. The device according to claim 1 wherein said body comprises a cylindrical roll of said cushioning material enclosed within a flexible sheath.

5. The device according to claim 4 wherein said roll of cushioning material comprises an inner part and an outer part, said parts having different densities.

6. The device according to claim 5 wherein said inner part is denser than said outer part.

7. A protective device for a person's neck comprising a resilient body formed of a cylindrical roll of cushioning material and having an arcuate bight portion from opposite ends of which a pair of arms extend, each of said arms terminating in a free end, said bight portion being dimensioned to embrace the back of such person's neck and said arms being dimensioned to overlie an upper portion of such person's chest; a flexible, substantially flat mounting strap having opposite ends, one end of said mounting strap being joined to the free end of one of said arms and the other end of said mounting strap being joined to the free end of the other of said arms, said body and said mounting strap together forming an open, substantially oval endless loop with said body forming one end of said loop, said loop being so dimensioned that those portions of said mounting strap adjacent said free ends of said arms may overlie the chest of such person and the remainder of said mounting strap may extend from said adjacent portions around and embrace such person's back; and an anchor strap coupled to said mounting strap and spanning said loop transversely of said loop and at a zone closer to said one end of said loop than to that end of said loop which is remote from said one end of said loop, thereby enabling said anchor strap also to overlie such person's chest, said anchor strap limiting movement of said arms and said adjacent portions of said mounting strap in a direction away from one another.

8. The device according to claim 7 wherein said mounting strap includes adjustable means for varying the size of said loop.

9. The device according to claim 7 wherein said mounting strap includes a separable buckle enabling said loop to be opened and closed.

10. The device according to claim 9 wherein said buckle is remote from said one end of said loop.

11. The device according to claim 7 including means for adjusting the length of said anchor strap.

12. The device according to claim 7 wherein said mounting strap and said anchor strap are inelastic.

13. The device according to claim 7 wherein said mounting strap has passages therein through which said anchor strap extends.

14. The device according to claim 7 wherein said mounting strap has a plurality of pairs of spaced passages therein, said anchor strap being accommodated within a selected pair of said passages.

15. The device according to claim 14 including means for adjusting the length of said anchor strap.

16. A device for protecting a person's neck comprising an arcuate, resilient body formed of a cylindrical roll of cushioning material and having a central part dimensioned to embrace the back and sides of a person's neck and from which cylindrical part two arms extend and terminate short of one another to form spaced apart, free ends, the resiliency of said body enabling the free ends thereof to move toward and away from one another and vary the curvature of said body; an elongate mounting strap having opposite ends one of which is joined to the free end of one of said arms and the other of which is joined to the free end of the other of said arms, said body and said mounting strap together forming an oval loop having opposite ends one of which is formed by said body; and an anchor strap coupled to said mounting strap and extending athwart said loop at a zone closer to said body than to that end of said loop opposite said one end of said body, said anchor strap limiting the distance the free ends of said body may move away from one another, thereby limiting the extent to which the curvature of said body between said free ends may be decreased, said loop being so dimensioned that when said resilient body embraces the back and sides of such person's neck said two arms and said anchor strap overlie an upper portion of such person's chest and that end of said loop remote from said one end thereof extends around such person's sides and embraces such person's back.

17. The device according to claim 16 wherein the length of said body is such as to enable the arms of said body to extend along opposite sides of such person's neck and overlie the upper portion of such person's torso with said anchor strap horizontally overlying such person's chest, said mounting strap being of such length as to extend from its juncture with said anchor strap and snugly embrace the back of such person.

18. The device according to claim 17 wherein said anchor strap is inelastic and includes means for adjusting its length.

19. The device according to claim 17 wherein said mounting strap is inelastic and includes means for adjusting its length.

20. The device according to claim 17 wherein each of said straps is inelastic and includes means for adjusting its length.

* * * * *